US006620377B2

(12) United States Patent
Ohma

(10) Patent No.: US 6,620,377 B2
(45) Date of Patent: Sep. 16, 2003

(54) HIGH HARDNESS STAINLESS STEEL FOR SCREWS USED IN MAGNETIC MEMORY DEVICES

(76) Inventor: Hideyuki Ohma, Daido Steel Co., Ltd., Hoshizaki Factory c/o 30, Daidocho 2-chome, Minami-ku, Nagoya-shi, Aichi-ken (JP)

( * ) Notice: Subject to any disclaimer, the term of this patent is extended or adjusted under 35 U.S.C. 154(b) by 0 days.

(21) Appl. No.: 09/853,633

(22) Filed: May 14, 2001

(65) Prior Publication Data

US 2002/0006349 A1 Jan. 17, 2002

(30) Foreign Application Priority Data

May 15, 2000 (JP) ..... 2000-141296
Feb. 8, 2001 (JP) ..... 2001-032331

(51) Int. Cl.[7] ..... C21C 38/58

(52) U.S. Cl. ..... 420/59; 420/58; 420/65; 420/73; 420/74

(58) Field of Search ..... 420/73, 74, 59, 420/58, 65; 148/327

(56) References Cited

U.S. PATENT DOCUMENTS 4,822,556 A * 4/1989 Cordea et al. ..... 420/59
4,851,059 A * 7/1989 Sumitomo et al. ..... 148/327
4,957,700 A * 9/1990 Honkura et al. ..... 420/74
6,110,421 A * 8/2000 Shimizu et al. ..... 420/57

* cited by examiner

*Primary Examiner*—Deborah Yee
(74) *Attorney, Agent, or Firm*—Varndell & Varndell, PLLC

(57) ABSTRACT

Disclosed is a high hardness stainless steel suitable as the material for screws used in fastening parts of magnetic memory devices such as hard disk drives. The stainless steel consists essentially of, by weight %, C: 0.03–0.15%, Si: 0.1–1.2%, Mn: 11.0–19.0%, P: up to 0.06%, S: up to 0.03%, Ni: 2.0–7.0%, Cr: 16.5–19.0%, N: 0.20–0.45% and the balance of Fe and inevitable impurities. This stainless steel exhibits improved hardness and anti-seizure property better than those of conventionally used SUS XM7. The steel may further contain at least one member of Al: up to 0.05%, Mg: 0.001–0.05%, Ca: 0.001–0.05%, V: 0.03–0.30% and Nb: 0.03–0.30%; and one or both of Cu: 1.0–4.0% and Mo: 0.5–5.0%.

3 Claims, 1 Drawing Sheet

HIGH HARDNESS STAINLESS STEEL FOR SCREWS USED IN MAGNETIC MEMORY DEVICES

BACKGROUND OF THE INVENTION

1. Field in the Industry

The present invention concerns a high hardness stainless steel for screws used in magnetic memory devices. More specifically, the invention concerns a high hardness stainless steel for screws which are used for fastening parts of magnetic memory devices, such as HDD (hard disk drive), made of a stainless steel.

2. Prior Art

In general, when parts of devices are combined and fastened with screws to set up the device, if hardness of the male screw and the female part are of the same level, then seizure of the tightly fastened threads may occur. When the seized screw is loosened at repairing of the device metal powder will fall out, and sometimes the metal powder causes failure or mulfunction of precision devices.

Hard disk drives, which are one of the precision devices, may be troubled if the above mentioned metal powder comes into the device. Therefore, in the magnetic memory devices it is necessary to use screws of such high hardness that they may not be seized and may not cause metal powder releasing. Also, it is desired that the screws used for setting up magnetic memory devices are non-magnetic so that they may not adhere to tools during the setting up.

The screws conveniently used in the magnetic memory devices are those having grooves of various shapes at the head, and the female threads to engage the screws are made of aluminum. Thus, the material for the screws have been stainless steel wires having a hardness higher than that of aluminum such as SUS XM7 (containing C: up to 0.08%, Si: up to 1.00%, Mn: up to 2.00%, Ni: 8.50–10.50%, Cr: 17.00–19.00% and Cu: 3.00–4.00% and the balance of Fe).

It is today's tendency to change the material of parts of the magnetic memory devices, in order to follow increasing memory capacity, from aluminum to stainless steels such as SUS 430 (containing C: up to 0.12%, Si: up to 0.75%, Mn: up to 1.00%, Cr: 16.00–18.00% and the balance of Fe) or equivalent steels. Then, the screws made of conventionally used SUS MX7 may cause, due to the small difference in hardness, seizure at fastening and may result in failure and mulfunction of the devices.

SUMMARY OF THE INVENTION

The object of the present invention is to provide a non-magnetic high hardness stainless steel for screws to be used in the magnetic memory devices, the stainless steel having a hardness higher than those of stainless steels (SUS430 or steels equivalent thereto) used for constructing magnetic memory devices and conventional SUSXM7 steel, and exhibiting anti-seizure property better than that of the conventional SUSXM7 steel.

This object is achieved by the stainless steel according to the present invention.

BRIEF EXPLANATION OF THE DRAWING

The attached drawing shows occurrence of cracks in screw heads produced in the working examples of this invention with the relation between the amounts of (C+N)% in the steel and the tensile strength of the material wire.

DETAILED EXPLANATION OF PREFERRED EMBODIMENTS OF THE INVENTION

Figure 1:
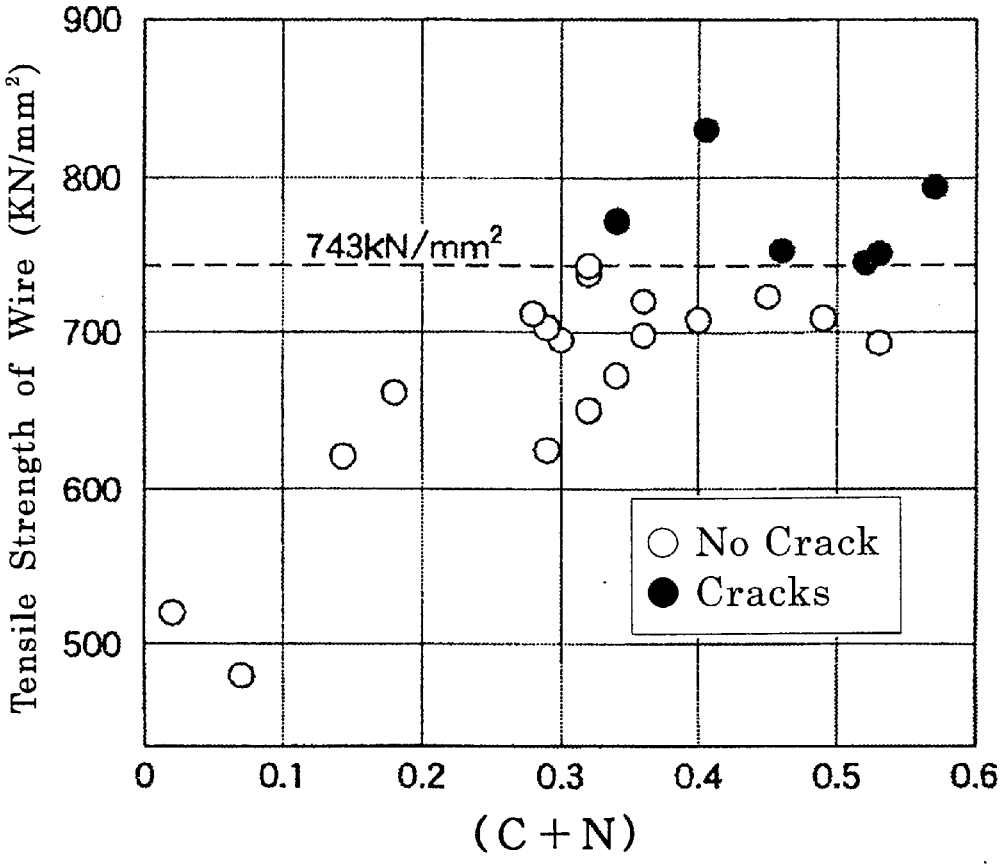

We have investigated non-magnetic stainless steels having hardness higher than that of SUS 430 and equivalents thereto, and anti-seizure property better than that of SUS XM7. It is our resulting discovery that choosing the alloy composition of Mn: 11.00–19.00%, or Ni: 11.00–15.00%, with C: 0.03–0.15% and N: 0.20–0.45% gives a steel of hardness higher than those of SUS 430 and SUS XM7 and anti-seizure property better than that of SUS XM7, and that the steel is non-magnetic with low magnetic permeability. Also, it is our discovery that N-content should be lowered to the range of 0.13–0.35% and that the tensile strength should be 743 kN/mm$^2$ or less, as seen from FIG. 1. Thus, there are three types in the high hardness stainless steel for screws used in magnetic memory devices according to the invention.

In the first embodiment of the present invention the stainless steel consists essentially of, as the basic alloy composition, by weight %, C: 0.03–0.15%, Si: 0.1–1.2%, Mn: 11.0–19.0%, P:up to 0.06%, S: up to 0.03%, Ni: 2.0–7.0%, Cr: 16.5–19.0%, N: 0.20–0.45% and the balance of Fe and inevitable impurities.

This stainless steel may contain, in addition to the above noted alloy components, at least one member selected from the group consisting of Al: up to 0.05%, Mg: 0.001–0.05%, Ca: 0.001–0.05%, V: 0.03–0.30% and Nb: 0.03–0.30%.

This stainless steel may further contain at least one member selected from the group consisting of Al: up to 0.05%, Mg: 0.001–0.05%, Ca: 0.001–0.05%, V: 0.03–0.30% and Nb: 0.03–0.30%, and one or both of Cu: 1.0–4.0% and Mo: 0.5–5.0%.

The stainless steel of the second embodiment consists essentially of, as the basic alloy composition, by weight %, C: 0.03–0.15%, Si: 0.1–1.2%, Mn: 0.5–2.0%, P: up to 0.06%, S: up to 0.03%, Ni: 11.0–15.0%, Cr: 16.5–19.0%, N: 0.20–0.45% and the balance of Fe and inevitable impurities.

This stainless steel also may contain, in addition to the above noted alloy components, at least one member selected from the group consisting of Al: up to 0.05%, Mg: 0.001–0.05%, Ca: 0.001–0.05%, V: 0.03–0.30% and Nb: 0.03–0.30%.

This stainless steel also may further contain at least one member selected from the group consisting of Al: up to 0.05%, Mg: 0.001–0.05%, Ca: 0.001–0.05%, V: 0.03–0.30% and Nb: 0.03–0.30%, and one or both of Cu: 1.0–4.0% and Mo: 0.5–5.0%.

The stainless steel of the third embodiment consists essentially of, by weight %, C: 0.03–0.15%, Si: 0.1–1.2%, Mn: 11.0–19.0%, P: up to 0.06%, S: up to 0.03%, Cu: 1.0–4.0%, Ni: 2.0–7.0%, Cr: 16.5–19.0% and N: 0.20–0.45%, provided that (C+N) is 0.16–0.30%, and the balance of Fe and inevitable impurities.

In the specification the term "screw" means male screws or bolts.

The following explains the reasons for limiting the ranges of the alloy compositions of the high hardness stainless steel for screws used in the magnetic memory device according to the present invention.

C: 0.03–0.15%

Carbon dissolves in the steel matrix to strengthen it. Also, carbon forms carbides to harden the steel and depresses formation of martensite induced by processing. To ensure these effects C-contents of 0.03% or more, preferably, 0.05% or more is necessary. Too much carbon lowers workability, resilience and corrosion resistance, and therefore, the content is limited to be up to 0.15%. A preferable content range is 0.05–0.12%.

Si: 0.1–1.2%

Silicon is used as the deoxidizer of the steel. A content of at least 0.1%, preferably, 0.3% or more is chosen. If the content exceeds 1.0% up to 1.2%, ferrite tends to occur in the steel. Thus, the Si-content must be 0.1–1.2%. A preferable range is 0.3–1.0%.

Mn: 11.0–19.0% in the first and the third embodiments

Manganese is useful as a deoxidizer of the steel, and enhances solution of nitrogen in the steel. Mn also makes the matrix to be austenite phase and depresses formation of martensite induced by processing. These effects may be obtained at a Mn-content of at least 11.0%. At a Mn-content higher than 19.0% resilience and corrosion resistance will decrease. Thus, the content is chosen from the range of 11.0–19.0%.

Mn: 0.5–2.0% in the second embodiment

In this embodiment manganese is useful also as the deoxidizer and enhances solution of nitrogen. These effects are obtainable even at such a low content as 0.5% or so, and a content exceeding 2.0% will lower the corrosion resistance. The Mn-content is thus decided to be 0.5–2.0%.

P: up to 0.06%

Phosphor is an impurity of the steel decreasing corrosion resistance thereof, and the lower the P-content the better. Influence of P is small at a content of 0.06% or less. A preferable upper limit is 0.04%.

S: up to 0.03%

Sulfur is also an impurity decreasing hot workability of the steel, and therefore, a lower S-content is preferable. At an S-content of 0.03% or less, the influence is not significant. Preferably, the S-content is minimized to be 0.02% or less.

Ni: 2.0–7.0% in the first and the third embodiments

Nickel, like manganese, makes the matrix austenite, and dissolves in the matrix to increase the resilience and the corrosion resistance. These effects can be observed at a content of 2.0% or higher, while a high Ni-content exceeding 7.0% will cause significant hardening when processed. Thus, the Ni-content is limited to be in the range of 2.0–7.0%. A preferable range is 2.45–5.8%, and a more preferable range is 2.45–3.95%.

Ni: 11.0–15.0% in the Second Embodiment

In addition to the above effects, nickel has another effect of depressing formation of martensite induced by processing. These effects are obtained at a Ni-content of 11.0% or higher. The cost of manufacturing the steel will become high at a higher Ni-content, and 15.0% is chosen as the upper limit thereof. A preferable range is 11.5–14.5%.

Cr: 16.50–19.0%

Chromium is added not only to increase the corrosion resistance of the steel but also to enhance the hardness and the strength by combining with carbon to form carbides. At least 16.5% of Cr-addition is necessary to ensure the effects. At a higher content exceeding 19.0% σ-phase will be formed, and thus this is the upper limit. A preferable content is in the range of 17.0–18.5%.

N: 0.20–0.45% in the First and the Second Embodiments

Nitrogen hardens the steel by, like carbon, dissolving in the matrix and by forming carbonitrides. Also, nitrogen depresses formation of martensite induced by processing and increases the resistance to corrosion, particularly, pitching. Too much addition such as 0.45% or higher causes formation of blow holes at casting the molten stell into ingots. Nitrogen of this content level decreases workability at blooming the ingots and screw forming. Thus, the N-content range is decided to 0.20–0.45%. A preferable range is 0.22–0.43%.

N: 0.13–0.35% in the Third Embodiment

In case where the workability of the steel is important, the above N-content range should be decreased to a lower level, 0.13–0.35%. A preferable range is 0.13–0.27%.

C+N: 0.16–0.30% in the Third Embodiment

If higher workability is required to the steel, for example, in the case of manufacturing a screw having a thin head with a large diameter such as, effective screw diameter 2.0 mm, head outer diameter 5.0 mm, and head thickness 0.5 mm, then the content of (C+N) must be in the range of 0.16–0.30%. A (C+N)-content less than 0.16% gives insufficient hardness and anti-seizure property to the product screws. On the other hand, a (C+N)-content larger than 0.30% may give a tensile strength higher than 743 $kN/mm^2$ to the steel, at which cracks tend to occur during forging the heads.

The following explains the roles of the optional alloy components and the reasons for limiting the composition ranges.

Al: up to 0.05%

Aluminum may be used as an effective deoxidizer of the steel. If, however, added to the steel in a large amount, it forms AlN to decrease effective N-content. Also, Al forms oxide inclusions to remain in the steel and damages hot workability. The Al-content must be thus up to 0.05%.

Mg: 0.001–0.05%

Magnesium is, like aluminum, effective as the deoxidizer of the steel. It fixes harmful sulfur to improve hot workability and compensates decrease in the hot workability caused by nitrogen addition. These effects can be observed at a content of 0.0015% or higher, and saturate at a content exceeding 0.05%. The range of 0.001–0.5% is thus set.

Ca: 0.001–0.05%

Calcium improves machinability and hot workability of the steel. A Ca-content of 0.001% or higher gives this effect, and the effect will saturates at a content exceeding 0.005%.

V: 0.03–0.30%

Vanadium forms carbides and nitrides thereof, which minute the crystal grains of the steel to strengthen and harden the matrix. This effect is available at a content of 0.03% or higher. Cold workability decreases at a V-content higher than 0.30%.

Nb: 0.03–0.30%

Niobium, like vanadium, forms carbides and nitrides thereof, which minute the crystal grains of the steel to strengthen and harden the matrix. An Nb-content of 0.03% or higher gives this effect. At a content exceeding 0.30% the nitrides remain as inclusions in the steel and damage cold workability.

Cu: 1.0–4.0%

Copper is optionally added for the purpose of improving corrosion resistance and cold workability, and decreasing hardening caused by processing. These effects are remarkable at a Cu-content of 1.0% or higher. Addition of Cu in an amount more than 4.0% decreases hot workability.

Mo: 0.5–5.0%

Molybdenum improves resistance to corrosion, particularly, pitching. Necessary addition amount to obtain this effect is at least 0.5%. Ferrite may be formed at addition amount larger than 5.0%. Thus, the above range, 0.5–5.0% is set. A preferable range is 1.0–4.5%.

Manufacturing the stainless steel for screws used in the magnetic memory devices according to the present invention is substantially the same as that for austenitic stainless steel containing nitrogen, and can be carried out by a conventional method known to those skilled in the art.

The present invention will be further explained in detail with reference to the working examples below.

EXAMPLES

Stainless steels of the alloy compositions shown in TABLE 1 were prepared with a vacuum high frequency induction furnace by ordinary method and the molten steels were cast into ingots. The ingots were hot forged to round rods of diameter 35 mm. By subsequent hot processing the steel rods were rolled to wires of diameter 5.5 mm. After repeated drawing and bright annealing the wires were finally drawn to diameter 2.85 mm. Test pieces for measuring the hardness and the tensile properties were prepared from the wires, and the test pieces were subjected to measurement of the hardness and the tensile strength at the room temperature. The results are shown in TABLE 2.

Male screws of outer diameter 2.5 mm were produced from the wires by forging. Magnetic permeability of the forged screws was measured. The results are also shown in TABLE 2. Then, the screws were repeatedly fastened and loosened with female threads of root diameter 2.5 mm made of SUS 430, and the cycle numbers of fastening-loosening until seizure was observed were recorded. diameter 2.5 mm made of SUS 430, and the cycle numbers of fastening-loosening until seizure was observed were recorded.

The above wires of diameter 5.5 mm was processed by repeated drawing and bright annealing to wires of diameter 1.7 mm. These wires were forged to screws of screw shape M2 (thread diameter)—0.4 (pitch)×3.0 (length under head), head diameter 5.0 mm, head thickness 0.5 mm and effective thread diameter 2.0 mm to determine whether cracks occur at the head of the screws during the forging. The results are shown in the column of "Crack Formation" in TABLE 2" and in FIG. 1.

TABLE 1

| | Alloy Compositions | | | | | | | | | | |
|---|---|---|---|---|---|---|---|---|---|---|---|
| No. | C | Si | Mn | P | S | Ni | Cr | N | C + N | Cu | Others |
| Examples | | | | | | | | | | | |
| 1 | 0.12 | 0.31 | 12.53 | 0.043 | 0.021 | 3.68 | 17.81 | 0.41 | 0.53 | 0.13 | — |
| 2 | 0.08 | 0.86 | 18.28 | 0.032 | 0.012 | 2.12 | 18.35 | 0.26 | 0.34 | 0.08 | — |
| 3 | 0.05 | 1.10 | 14.25 | 0.051 | 0.005 | 3.11 | 16.85 | 0.31 | 0.36 | 0.21 | Al:0.03 |
| 4 | 0.14 | 0.23 | 18.91 | 0.022 | 0.008 | 3.92 | 17.21 | 0.43 | 0.57 | 0.32 | Mg:0.008 V:0.01 |
| 5 | 0.09 | 0.05 | 11.21 | 0.048 | 0.026 | 3.06 | 18.92 | 0.23 | 0.32 | 1.80 | Al:0.003 Nb:0.05 |
| 6 | 0.11 | 0.53 | 16.72 | 0.034 | 0.016 | 2.86 | 17.54 | 0.21 | 0.32 | 0.03 | Ca:0.012 V:0.01 |
| 7 | 0.10 | 0.13 | 15.13 | 0.013 | 0.015 | 2.47 | 18.36 | 0.36 | 0.46 | 0.16 | Al:0.001 Mo:0.85 |
| 8 | 0.13 | 0.30 | 0.70 | 0.042 | 0.022 | 11.37 | 17.99 | 0.33 | 0.36 | 0.07 | — |
| 9 | 0.07 | 0.85 | 0.98 | 0.021 | 0.029 | 12.49 | 18.36 | 0.27 | 0.34 | 0.22 | — |
| 10 | 0.04 | 1.19 | 1.73 | 0.051 | 0.012 | 14.32 | 16.72 | 0.24 | 0.28 | 0.11 | Mg:0.04 |
| 11 | 0.15 | 0.43 | 0.62 | 0.015 | 0.003 | 0.04 | 13.38 | 17.33 | 0.37 | 0.52 | Al:0.06 Nb:0.02 |
| 12 | 0.11 | 0.06 | 1.51 | 0.032 | 0.008 | 0.06 | 11.46 | 18.61 | 0.21 | 0.32 V: 0.06 | Al:0.001 Mo:2.10 |
| 13 | 0.06 | 0.61 | 1.21 | 0.028 | 0.018 | 0.11 | 12.21 | 17.21 | 0.43 | 0.49 | Ca:0.18 Mo:1.20 |
| 14 | 0.09 | 0.13 | 0.13 | 0.038 | 0.025 | 2.20 | 14.05 | 16.22 | 0.36 | 0.45 | Al:0.01 |
| 15 | 0.05 | 0.21 | 13.03 | 0.026 | 0.003 | 1.30 | 2.61 | 17.31 | 0.13 | 0.18 | — |
| 16 | 0.06 | 0.33 | 11.51 | 0.028 | 0.001 | 2.21 | 6.73 | 18.21 | 0.23 | 0.29 | — |
| 17 | 0.08 | 0.36 | 12.22 | 0.021 | 0.006 | 3.96 | 3.29 | 17.73 | 0.22 | 0.30 | — |
| Control Examples | | | | | | | | | | | |
| 1 | 0.05 | 0.21 | 9.21 | 0.041 | 0.026 | 0.21 | 2.11 | 18.21 | 0.24 | 0.29 | — |
| 2 | 0.12 | 0.38 | 21.35 | 0.031 | 0.018 | 0.09 | 2.48 | 17.55 | 0.29 | 0.41 | — |
| 3 | 0.14 | 0.19 | 1.91 | 0.024 | 0.012 | 0.21 | 13.12 | 15.37 | 0.32 | 0.40 | — |
| 4 | 0.08 | 0.73 | 1.21 | 0.051 | 0.008 | 0.21 | 13.12 | 15.37 | 0.32 | 0.40 | — |
| 5 | 0.04 | 0.44 | 0.64 | 0.032 | 0.017 | 0.03 | 11.21 | 17.38 | 0.10 | 0.14 | — |
| 6 | 0.04 | 0.31 | 0.55 | 0.031 | 0.004 | 0.13 | 0.12 | 16.21 | 0.03 | 0.07 | — |
| 7 | 0.01 | 0.21 | 0.71 | 0.032 | 0.001 | 0.19 | 8.73 | 17.25 | 0.01 | 0.02 | — |

TABLE 2

| | Test Results | | | | |
|---|---|---|---|---|---|
| No. | Hardness (Hv) | Tensile Strength ($kN/mm^2$) | Anti-Seizure Property | Permeability ($\mu$) | Crack Formation |
| Examples | | | | | |
| 1 | 312 | 751 | excellent | 1.004 | yes |
| 2 | 319 | 772 | excellent | 1.002 | yes |
| 3 | 301 | 770 | excellent | 1.003 | no |
| 4 | 328 | 794 | excellent | 1.002 | yes |
| 5 | 270 | 743 | excellent | 1.005 | no |
| 6 | 308 | 738 | excellent | 1.003 | no |
| 7 | 314 | 753 | excellent | 1.003 | yes |
| 8 | 272 | 698 | excellent | 1.006 | no |
| 9 | 267 | 672 | excellent | 1.005 | no |
| 10 | 279 | 712 | excellent | 1.004 | no |
| 11 | 281 | 745 | excellent | 1.004 | yes |
| 12 | 261 | 650 | excellent | 1.005 | no |
| 13 | 277 | 709 | excellent | 1.005 | no |

TABLE 2-continued

Test Results

| No. | Hardness (Hv) | Tensile Strength (kN/mm$^2$) | Anti-Seizure Property | Permeability ($\mu$) | Crack Formation |
|---|---|---|---|---|---|
| 14 | 283 | 723 | excellent | 1.004 | no |
| 15 | 265 | 661 | excellent | 1.003 | no |
| 16 | 270 | 703 | excellent | 1.002 | no |
| 17 | 269 | 695 | excellent | 1.003 | no |
| Control Examples | | | | | |
| 1 | 241 | 625 | good | 1.009 | no |
| 2 | 349 | 831 | heading impossible | — | yes |
| 3 | 277 | 693 | excellent | 1.03 | yes |
| 4 | 280 | 708 | excellent* | 1.004 | no |
| 5 | 246 | 621 | good | 1.009 | no |
| 6 | 171 | 479 | poor | — | no |
| 7 | 210 | 520 | poor | 1.026 | no |

*corrosion resistance dissatisfactory

Anti-seizure property excellent: more than 400 times of good: 399-30 times of poor: less than 30 times of Permeability Those of 1.01 or less can be used as the material for screws.

The examples have hardness of Hv 261–328, tensile strength of 650–794 kN/mm2, permeability of 1.002–1.006, and the times of fastening-loosening until the seizure occurs are more than 400. Cracks occurred in some of the test forging. No crack was observed in the examples having tensile strength of 743 kN/mm2 or less, particularly, in runs 15–17.

Control example 1, in which Mn-content is less than the lower limit of this invention, has low hardness and tensile strength and exhibited poor anti-seizure property. On the other hand, control example 2, which contains more Mn than the upper limit of the alloy composition of this invention has too high hardness to forge screw heads, and cracks were observed at the crack formation tests of screw forming.

In control example 3, in which Ni-content is lower than the lower limit defined in this invention, magnetic permeability of the alloy is too high.

Corrosion resistance of control example 4, in which Cr-content is less than the lower limit defined in this invention, is low and the material is not useful for producing screws.

Control example 5 containing N less than the lower limit of this invention has low hardness and tensile strength, and the anti-seizure property is dissatisfactory.

Control example 6, equal to SUS 430, though not suitable to compare because of magnetic property of this steel, has low hardness and tensile strength as well as poor anti-seizure property.

Conventionally used SUS MX7, tested as control example 7, has poor anti-seizure property, and further, magnetic permeability is too high.

As explained above, the high hardness stainless steel according to the invention for screws used in magnetic memory devices, because of the above described alloy composition, is not magnetic and exhibits enough hardness and anti-seizure property when the screws made of this steel are fastened. No crack occurs in the steel of this invention with improved processability even if the forging ratios are high.

I claim:

1. A high hardness stainless steel having good anti-seizure property for screws used in magnetic memory devices, consisting essentially of, by weight %, C: 0.03–0.15%, Si: 0.1–1.2%, Mn: 11.0–19.0%, P: up to 0.06%, S: up to 0.03%, Cu: 1.0–4.0%, Ni: 2.0–7.0%, Cr: 16.5–19.0% and N: 0.20–0.45%, provided that C%+N% is 0.16–0.30, and the balance of Fe and inevitable impurities.

2. A high hardness stainless steel having good anti-seizure property for screws used in magnetic memory devices, consisting essentially of, by weight %, C: 0.03–0.15%, Si: 0.1–1.2%, Mn: 11.0–19.0%, P: up to 0.06%, S: up to 0.03%, Ni: 2.0–7.0%, Cr: 16.5–19.0%, N: 0.20–0.45%, Al: up to 0.05%, one or both of Mg: 0.001–0.05% and Nb: 0.03–0.30%, and the balance of Fe and inevitable impurities.

3. A high hardness stainless steel according to claim 2, wherein the stainless steel further contains, in addition to the alloy components set forth in claim 2, one or both of Cu: 1.0–4.0% and Mo: 0.5–5.0%.

* * * * *